United States Patent [19]

Kupper

[11] Patent Number: 4,514,170

[45] Date of Patent: Apr. 30, 1985

[54] APPARATUS FOR THE HEAT TREATMENT OF FINE-GRAINED MATERIAL

[75] Inventor: Detlev Kupper, Ennigerloh, Fed. Rep. of Germany

[73] Assignee: Krupp Polysius AG, Beckum, Fed. Rep. of Germany

[21] Appl. No.: 533,603

[22] Filed: Sep. 19, 1983

[30] Foreign Application Priority Data

Oct. 12, 1982 [DE] Fed. Rep. of Germany ..... 3237689

[51] Int. Cl.[3] ..... F27B 7/02

[52] U.S. Cl. ..... 432/106; 432/78; 432/14; 432/58

[58] Field of Search ..... 432/106, 58, 14, 78

[56] References Cited

U.S. PATENT DOCUMENTS

| | | | |
|---|---|---|---|
| 3,904,353 | 9/1975 | Bosshard et al. | 432/14 |
| 3,925,091 | 12/1975 | Yoshida et al. | 432/106 |
| 4,014,641 | 3/1977 | Shigeyoshi et al. | 432/58 |
| 4,105,396 | 8/1978 | Ritzmann | 432/14 |
| 4,111,158 | 9/1978 | Reh et al. | 432/58 |
| 4,209,296 | 6/1980 | Deussner | 432/14 |
| 4,226,586 | 10/1980 | Brachthauser et al. | 432/106 |
| 4,248,639 | 2/1981 | Quittkat | 432/58 |
| 4,370,127 | 1/1983 | Abelitis | 432/58 |
| 4,425,092 | 1/1984 | Brachthauser et al. | 432/106 |

*Primary Examiner*—Henry C. Yuen

*Attorney, Agent, or Firm*—Learman & McCulloch

[57] ABSTRACT

Apparatus for heat treating fine-grained material comprises a rotary kiln into which material is delivered from a multistage preheater that communicates with the kiln via a vertical exhaust gas duct. Treated material is discharged from the kiln to a cooler from which two cooling air ducts extend and communicate with the exhaust gas duct at two vertically spaced zones. Material from the second lowest preheater stage is introduced into the exhaust gas duct adjacent the lower cooling air duct. Fuel is introduced into the exhaust gas duct adjacent each of the cooling air ducts. The apparatus is distinguished by a particularly high degree of deacidification of the raw material and good combustion of the fuel.

11 Claims, 2 Drawing Figures

φ
S2
S1
1
2
3
4
4a
4b
4'a
4'b
5
6
7
11
12
13
14
15
16
17
18
19
20
21
22

APPARATUS FOR THE HEAT TREATMENT OF FINE-GRAINED MATERIAL

The invention relates to apparatus for the heat treatment of fine-grained material, particularly for the production of cement, having a cyclone preheater consisting of a plurality of stages arranged one above the other, a rotary kiln, a cooler and a precalcination zone which is formed by the kiln exhaust gas duct between the rotary kiln and the cyclone preheater and is supplied with additional fuel, the exhaust gases from the rotary kiln flowing substantially upwards from below through the precalcination zone into which open two cooling air ducts connected to the cooler.

In known apparatus for the heat treatment of fine-grained material (German Offenlegungsschrift No. 2801161) the exhaust gas duct leading from the rotary kiln to the lowest cyclone stage of the preheater is provided with a plurality of constrictions lying one above the other and in each case fuel and air are introduced in the region of these cross-sectional constrictions. The material discharged from the second lowest cyclone stage is introduced into the lowest region of the kiln exhaust gas duct.

This known construction has various disadvantages. Because of the number of cross-sectional constrictions in the kiln exhaust gas duct it has a relatively complicated construction which means that it is not suitable for installation on existing apparatus. There is also the danger of disruptive material deposits forming in the region of the cross-sectional constrictions in the kiln exhaust gas duct. In addition, because the material to be preheated and the fuel are introduced into the kiln exhaust gas duct at different points independently of each other the heat transfer from the fuel via the gas to the material is not very favourable.

These disadvantages of the known construction are avoided in apparatus developed by the applicants (European Pat. No. 2054) in which two cooling air ducts open at opposite points into the kiln exhaust gas duct and the material discharge ducts from the second lowest cyclone stage and optionally additional burners are connected to these cooling air ducts just before the points where they open into the kiln exhaust gas duct. Such a construction makes it possible to achieve a complete and very uniform heat transfer from the fuel to the material with little expenditure on apparatus for the precalcination zone.

The object of the invention is to further improve this known apparatus so that a particularly high degree of deacidification of the raw material and good combustion of the fuel are achieved.

This object is achieved according to the invention by the following features:

(a) the two cooling air ducts open into the kiln exhaust gas duct at different points in its height;

(b) both cooling air ducts are provided with supply lines for the additional fuel close to the points where they open into the kiln exhaust gas duct;

(c) the material discharge duct from the second lowest cyclone stage opens into the lower cooling air duct.

Before the technical advance achieved by the arrangement according to the invention is described, a number of terms will be explained.

"Deacidification" or "precalcination" should be understood to mean the expulsion of the $CO_2$ from $CaCO_3$ according to the following equation:

$$CaCO_3 \underset{\text{recarbonation}}{\overset{\text{deacidification}}{\rightleftharpoons}} CaO + CO_2$$

"Recarbonation" is the reverse process. Here material (CaO) which is already deacidified again takes up $CO_2$ because of a high $CO_2$ partial pressure or because of a low material temperature.

It has now been established that the deacidification reaction begins to stagnate at certain temperature and $CO_2$ partial pressure ratios so that a quasi-balance is reached between the two reactions referred to above. No further increase in the degree of deacidification can then be expected in the precalcination zone.

The actual degree of deacidification should be understood to mean the ratio of the $CO_2$ actually driven out of the raw material to the $CO_2$ originally present in the raw material. The apparent degree of deacidification is the ratio of the $CO_2$ content of a material sample removed at a specific point in the apparatus to the $CO_2$ content of the raw material (in view of the highly deacidified material in dust form circulating in the apparatus the apparent degree of deacidification is generally higher than the actual degree of deacidification).

The invention is based upon the recognition that the $CO_2$ partial pressure can be reduced and the stagnating deacidification reaction can be advanced by a second cooling air duct opening into the kiln exhaust gas duct at a higher position. However, it is essential that the reduction in the $CO_2$ partial pressure resulting from the further supply of cooling air takes place without reduction in the temperature. For this purpose the upper cooling air duct is also provided with a supply line for additional fuel.

Thus in the arrangement according to the invention the degree of deacidification increases rapidly in the first precalcination section (i.e. from the point where the lower cooling air duct opens into it to the point where the upper cooling air duct opens into it). Then before recarbonation occurs and a quasi-balance between deacidification and recarbonation is set up the $CO_2$ concentration is reduced by the additional quantity of tertiary air supplied via the upper cooling air duct. This results in a further sharp increase in the degree of deacidification and good combustion of the fuel.

The experiments on which the invention is based showed that one single fuel supply to the precalcination zone (without the upper supply of cooling air) is not sensible because the resulting high $CO_2$ partial pressure has an extreme hindering effect on the deacidification and a low oxygen supply and high $CO_2$ supply are not favourable for complete combustion. The necessary quantity of air for combustion would have to be drawn through the rotary kiln in this case. With a single fuel supply (third firing without tertiary air, i.e. cooling air) a further deacidification in the precalcination zone would only be possible by increasing the temperature. However, this would also increase the exhaust gas temperature and with it the specific total heat consumption.

By contrast the arrangement according to the invention facilitates a significant increase in the degree of efficiency of the precalcination zone without significant additional expenditure on apparatus.

Advantageous embodiments of the invention are the subject matter of the subordinate claims and are explained in greater detail in connection with the description of an embodiment which is illustrated in the drawings, in which:

Figures 1, 2:
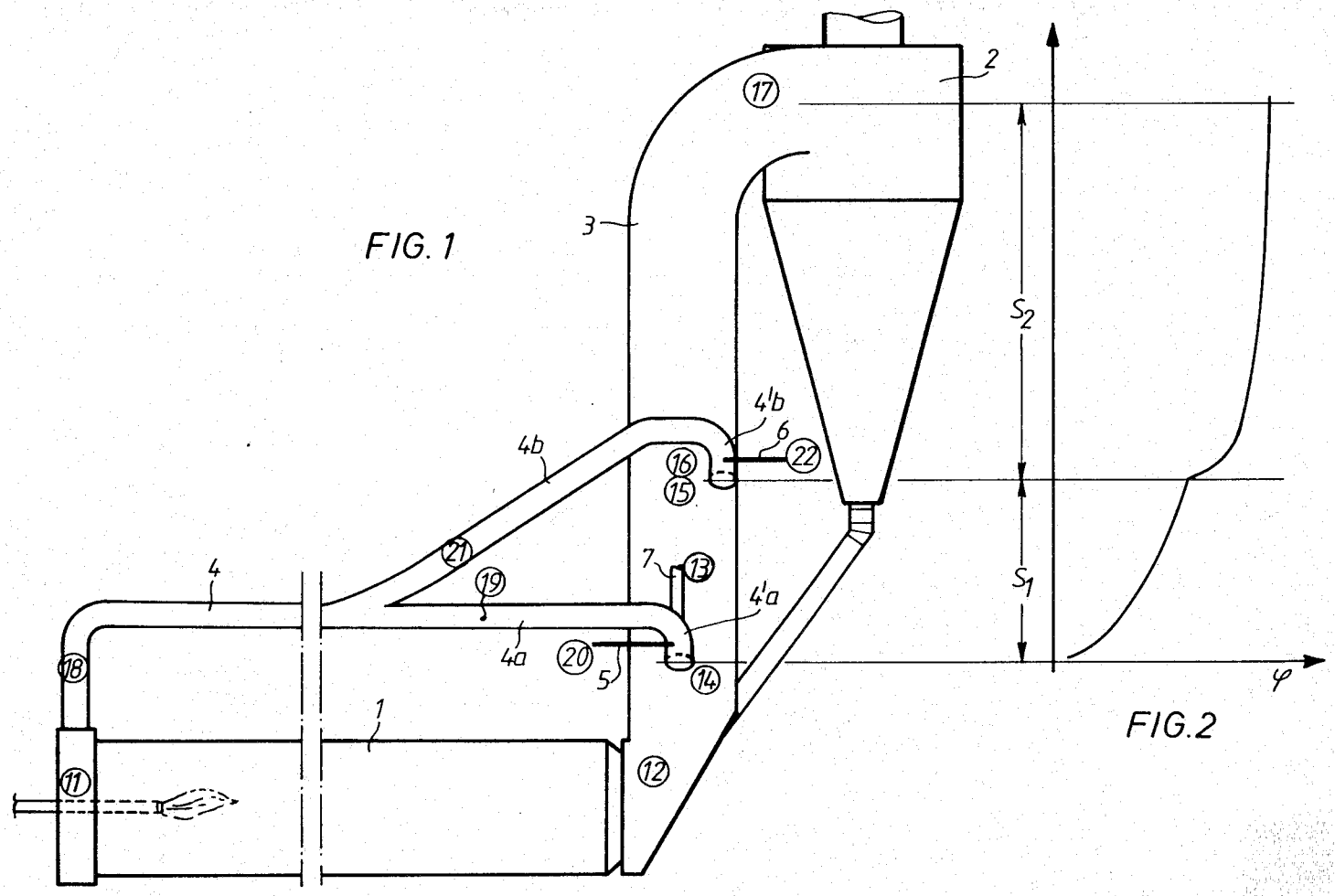
FIG. 1 shows a basic schematic view of apparatus according to the invention.
FIG. 2 shows a diagram illustrating the course of the deacidification in the precalcination zone.

The apparatus according to FIG. 1 contains a rotary kiln 1, a multi-stage cyclone preheater of known construction which is only partially illustrated, namely as regards the lowest cyclone stage 2, and a kiln exhaust gas duct 3 which leads from the rotary kiln 1 to the lowest cyclone stage 2 and forms the precalcination zone.

A duct 4 leads from the cooler which is not shown to the kiln exhaust gas duct 3. The duct 4 is divided into a lower and an upper cooling air duct 4*a*, 4*b* which open into the kiln exhaust gas duct 3 at different points in its height. The lower cooling air duct 4*a* opens approximately centrally or diametrally into the kiln exhaust gas duct 3 and the upper cooling air duct 4*b* opens approximately tangentially into the duct 3. Both cooling air ducts 4*a*, 4*b* have a downwardly-inclined part 4'*a* and 4'*b* respectively before they open into the kiln exhaust gas duct 3.

Supply lines 5, 6 for additional fuel are provided near the points where the cooling air ducts 4*a*, 4*b* open into the kiln exhaust gas duct 3. In addition to material discharge duct 7 from the second lowest cyclone stage (not shown) of the multi-stage cyclone preheater opens into the lower cooling air duct 4*a*.

Thus in the lower cooling air duct 4*a*, shortly before the point where this cooling air duct opens into the kiln exhaust gas duct 3, the fuel supplied via the supply line 5 is mixed with the preheated material introduced via the duct 7 and the cooling air supplied via the duct 4*a* so that when this fuel-material-air mixture enters the kiln exhaust gas duct 3 a spontaneous combustion of the fuel on the material occurs.

The degree of deacidification $\pi$ thus increases rapidly in this first precalcination section $s_1$ which extends from the point where the lower cooling air duct 4*a* opens into the kiln exhaust gas duct 3 to the point where the upper cooling air duct 4*b* opens into the duct 3.

If a further quantity of fuel and air is then introduced into the kiln exhaust gas duct 3 through the upper cooling air duct 4*b* then as a result of the reduction in the $CO_2$ partial pressure the deacidification reaction is advanced in the second precalcination section $s_2$ which extends from the point where the upper cooling air duct 4*b* opens into the kiln exhaust gas duct 3 to the lowest cyclone stage 2 of the preheater.

The following values could be provided for example in a practical construction of apparatus according to the invention;

length $s_1$ of the first precalcination section: 4 to 8, preferably 5 to 6 m;

length $s_2$ of the second precalcination section: 7 to 15, preferably 9 to 12 m;

total degree of precalcination: 50 to 60%;

degree of precalcination in the first precalcination section: 40 to 50%;

excess air coefficient (in the rotary kiln): 1.0 to 1.1;

excess air coefficient at the second firing, i.e. fuel supply line 5: 1.1 to 1.2;

excess air coefficient at the third firing, i.e. fuel supply line 6: 1.3 to 2.5;

temperature at the end of the precalcination zone (depending upon the reactivity of the raw material): 830° to 860° C.

For further explanation of the operating conditions with such apparatus the measurements taken at the measuring points 11 to 22 (cf. FIG. 1) are given:

| Measuring point: | |
|---|---|
| 11 | fuel 335 kcal/kg clinker<br>excess air coefficient 1.1<br>secondary air 0.0502 kg/kg clinker |
| 12 | gas and dust temperature 1240° C.<br>$CO_2$ concentration 22%<br>dust return from the rotary kiln 0.2 kg/kg clinker (dust is 100% deacidified) |
| 13 | material from the second lowest cyclone stage 1.53 kg/kg clinker (degree of deacidification 0%)<br>dust from the second lowest cyclone stage 0.2 kg/kg clinker (degree of deacidification 90%)<br>apparent degree of deacidification 11%<br>material and dust temperature 700° C. |
| 14 | $CO_2$ concentration after mixing 12.6%<br>maximum apparent degree of deacidification 20% |
| 15 | gas, material and dust temperature 870° C.<br>actual degree of deacidification 60%<br>apparent degree of deacidification 69%<br>$CO_2$ concentration 27% |
| 16 | $CO_2$ concentration after mixing 24%<br>excess air coefficient 1.2 |
| 17 | material and dust 1.48 kg/kg clinker<br>gas, material and dust temperature 840° C.<br>actual degree of deacidification 85%<br>apparent degree of deacidification 89%<br>$CO_2$ concentration 30% |
| 18 | tertiary air temperature 703° C.<br>quantity of tertiary air 0.0742 kg/kg clinker |
| 19 | quantity of tertiary air (second firing) 0.0513 kg/kg clinker<br>tertiary air temperature 703° C. |
| 20 | fuel/second firing 314 kcal/kg clinker<br>excess air coefficient 1.2 |
| 21 | quantity of tertiary air (third firing) 0.0206 kg/kg clinker<br>tertiary air temperature 703° C. |
| 22 | fuel/third firing 101 kcal/kg clinker<br>excess air coefficient 1.5 |

What is claimed is:

1. In apparatus for the heat treatment of fine-grained material having a multistage preheater communicating with a kiln via an upwardly extending exhaust gas duct forming a precalcination zone into which fuel is introduced between said kiln and said preheater, and a cooler into which heat treated material is delivered from said kiln, the improvement comprising a pair of cooling air ducts extending between said cooler and said exhaust gas duct and communicating with the latter at vertically spaced zones; means for introducing said fuel into each of said ducts to form a mixture of fuel and air for delivery into said exhaust gas duct adjacent each of said zones; and material duct means communicating between said preheater and the lower one of said cooling air ducts for delivering preheated material to the latter from said preheater.

2. Apparatus according to claim 1 wherein one of said air ducts communicates with said exhaust gas duct substantially diametrally thereof and the other of said air ducts communicates with said exhaust gas duct substantially tangentially thereof.

3. Apparatus according to claim 1 wherein each of said air ducts communicates with said exhaust gas duct along a downwardly inclined path.

4. Apparatus according to claim 1 wherein the air duct at the higher zone communicates with said exhaust gas duct substantially tangentially thereof.

5. Apparatus according to claim 1 wherein the air duct at the lower of said zones communicates with said exhaust gas duct substantially diametrally thereof.

6. Apparatus according to claim 1 wherein the distance between said zones comprises a first precalcination section and the distance between the higher of said zones and said preheater comprises a second precalcination section, said first and second sections being of different lengths.

7. Apparatus according to claim 6 wherein said first precalcination section is shorter in length than said second precalcination section.

8. Apparatus according to claim 6 wherein said first precalcination section has a length of between about 4 and 8 m.

9. Apparatus according to claim 6 wherein said first precalcination section has a length of between about 5 and 6 m.

10. Apparatus according to claim 6 wherein said second precalcination section has a length of between about 7 and 15 m.

11. Apparatus according to claim 6 wherein said second precalcination section has a length of between about 9 and 12 m.

* * * * *